US007000788B2

(12) United States Patent
Wüster

(10) Patent No.: US 7,000,788 B2
(45) Date of Patent: Feb. 21, 2006

(54) UMBRELLA-TYPE LAUNDRY DRYING APPARATUS WITH PROTECTIVE COVER

(76) Inventor: Heinrich Wüster, Unterm Hohen Rain 16, Imst/Tirol (AT) A-6460

( * ) Notice: Subject to any disclaimer, the term of this patent is extended or adjusted under 35 U.S.C. 154(b) by 0 days.

(21) Appl. No.: 11/061,594

(22) Filed: Feb. 18, 2005

(65) Prior Publication Data

US 2005/0145590 A1 Jul. 7, 2005

Related U.S. Application Data

(63) Continuation of application No. PCT/EP03/08991, filed on Aug. 13, 2003.

(30) Foreign Application Priority Data

Aug. 23, 2002 (AT) ..... A 1264/2002

(51) Int. Cl.
*A47B 43/00* (2006.01)

(52) U.S. Cl. ..... 211/197; 211/1.3; 211/119.18; 211/205

(58) Field of Classification Search ..... 211/197, 211/1.3, 99, 100, 101, 102, 96, 180, 205, 211/196, 119.18, 119.01; 135/33.2, 34.2, 135/33.6; 312/297

See application file for complete search history.

(56) References Cited

U.S. PATENT DOCUMENTS

| | | | | | |
|---|---|---|---|---|---|
| 483,275 | A | * | 9/1892 | Adler | 211/1.3 |
| 2,443,772 | A | * | 6/1948 | Mappin | 135/26 |
| 2,784,848 | A | * | 3/1957 | Senne | 211/196 |
| 3,069,021 | A | * | 12/1962 | Gray | 211/197 |
| 3,490,469 | A | * | 1/1970 | Dubinsky | 135/34.2 |
| 3,920,127 | A | * | 11/1975 | LaBeaud | 211/118 |
| 4,225,048 | A | * | 9/1980 | Hildreth | 211/1.3 |
| 4,732,285 | A | | 3/1988 | Wüster | |

FOREIGN PATENT DOCUMENTS

EP 0 214 123 A2 3/1987

* cited by examiner

*Primary Examiner*—Jennifer E. Novosad
(74) *Attorney, Agent, or Firm*—Laurence A. Greenberg; Werner H. Stemer; Ralph E. Locher

(57) ABSTRACT

An umbrella-type clothes drier can be covered with a protective cover when it is not in use. An unfolding and folding spreading frame that supports a clothesline is preferably disposed in an adjustable manner on the central upright tube of the apparatus. The protective cover can be pulled over the folded spreading frame and the clothesline from the upright tube and can be retracted into the upright tube at the inner end section thereof, which remains inside the upright pipe. The outer end section of the protective cover supports a cap which overlaps the upper end of the upright tube when the protective cover is retracted into the upright tube.

7 Claims, 1 Drawing Sheet

UMBRELLA-TYPE LAUNDRY DRYING APPARATUS WITH PROTECTIVE COVER

CROSS-REFERENCE TO RELATED APPLICATION

This is a continuing application, under 35 U.S.C. § 120, of copending international application No. PCT/EP2003/008991, filed Aug. 13, 2003, which designated the United States; this application also claims the priority, under 35 U.S.C. § 119, of Austrian patent application No. A 1264/2002, filed Aug. 23, 2002; the prior applications are herewith incorporated by reference in their entirety.

BACKGROUND OF THE INVENTION

Field of the Invention

The invention relates to an umbrella-type clothes drier, in which a spreading frame, which can be unfolded and folded together again and carries the clothes line, is arranged preferably adjustably on a central upright tube. A protective cover is provided, which can be pulled out of the upright tube over the folded-together spreading frame and the clothes line and can be pulled back into the upright tube again at its inner end portion, which remains in the upright tube.

Such a clothes drier is known, by way of example, from my earlier European patent EP 214 123 B and my U.S. Pat. No. 4,732,285. When the spreading frame is in its unfolded state with the clothes line extended, the protective cover is pulled back into the upright tube. If the clothes drier is not to be used for a relatively long time, its spreading frame is folded together and the protective cover is pulled over the folded-together spreading frame and clothes line from above and fastened with its outer end portion to the upright tube below the lower sliding sleeve of the spreading frame, which has been moved downward along the tube. When the clothes drier is open, dirt or rainwater can find its way into the interior of the protective cover pulled back into the upright tube at the upper side thereof. The rainwater can run downward in the upright tube along the protective cover and come out of the tube at its lower end. The clothes drier is in most cases erected in the open air and anchored in the ground with its upright tube, so that the rainwater can seep away in the ground. When the protective cover has been pulled over the folded-together spreading frame and fastened to the upright tube below the spreading frame, the weight connected to the inner end portion of the protective cover, which pulls the freed protective cover downward back into the upright tube, is located in its uppermost position close to the upper end of the upright tube and prevents large quantities of rainwater entering the upright tube.

In the case of the prior clothes drier, it has to be ensured at the erection site, as far as the ground sleeve necessary for anchoring its upright tube in the ground is concerned, that rainwater entering the upright tube can seep away in the ground in the region of the ground sleeve.

SUMMARY OF THE INVENTION

It is accordingly an object of the invention to provide an umbrella-type laundry drying apparatus or clothes dryer, which overcomes the above-mentioned disadvantages of the heretofore-known devices and methods of this general type.

With the foregoing and other objects in view there is provided, in accordance with the invention, an umbrella-type laundry-drying apparatus, comprising:

a central upright tube formed with an inner space and an upper end;

a spreading frame movably mounted on said upright tube for spreading outwardly from said upright tube into a spread-out position and folding back toward said upright tube into a folded position;

a protective cover disposed to be pulled out of said inner space in said upright tube and over said spreading frame in said folded position and to be pulled back into said inner space of said upright tube; and a covering mounted to said protective cover on an outer end portion thereof, said covering overlapping said upper end of said upright tube when said protective cover has been pulled back into said inner space of said upright tube.

According to the invention, this is achieved by virtue of the fact that the protective cover bears on its outer end portion a covering which overlaps the upper side of the upright tube when the protective cover has been pulled back into the upright tube.

By means of the covering, which is movable together with the protective cover and positions itself over the upper end of the upright tube when the protective cover has been pulled back into the upright tube, dirt and rainwater are prevented, when the clothes drier is open, from finding their way into the interior of the upright tube or the protective cover pulled back into it and subsequently, when the protective cover is pulled over the folded-together spreading frame, from being able to run down on the outside of the protective cover surrounding the folded-together clothes drier. A further advantage of this design consists in that, at the erection site of the clothes drier, no constructional precautions for the seeping away of the rainwater in the ground have to be taken as far as the ground sleeve necessary for anchoring its upright tube is concerned in terms of manufacture or introduction into the ground.

According to the invention, a covering flap connected to the outer end portion of the protective cover can be provided as a covering.

The covering flap is attached laterally to the outer end portion of the protective cover on the outside of the protective cover. It projects upwardly there and, at the upper end of the upright tube, where the protective cover is deflected through 180° into the interior of the upright tube, is pushed over the upper end of the upright tube by the protective cover which has been pulled into the upright tube below it. When the protective cover has been pulled back into the upright tube completely, the covering flap overlaps the upper end of the upright tube and covers its opening upwardly.

The covering which is movable together with the protective cover can also consist of two flaps which are attached laterally in opposite locations of the outer end portion of the protective cover and are, at the upper end of the upright tube, pushed over the upper end of the upright tube from opposite sides by the protective cover which has been pulled into the upright tube below them. In this connection, the two flaps can abut against one another with their end edges and in this way terminate the pulling of the protective cover into the upright tube. The two flaps can have stops assigned to one another, with which they meet one another while they are pushed over the upper end of the upright tube from opposite sides by the protective cover which has been pulled into the upright tube below them. The meeting of the stops of the two flaps terminates the pulling of the protective cover into the upright tube, while the end-side end portions of the two flaps overlap.

According to a further feature of the invention, an at least two-part covering can be connected to the outer end portion of the protective cover, the covering parts of which are arranged distributed around the outer end portion of the protective cover and, when the protective cover has been pulled back into the upright tube, together cover the upper opening of the upright tube.

Material pockets, in which rigid, leaf-shaped covering parts projecting from the material pockets are received, which are pushed forward laterally over the upper opening of the upright tube by the protective cover which has been pulled back into the upright tube and cover it completely when the protective cover has been pulled back into the upright tube completely, can be attached to the outer end portion of the protective cover.

According to the invention, the covering parts which together cover the upper side of the upright tube when the protective cover has been pulled back into the upright tube can overlap one another at least partly. This design allows greater tolerances during both the manufacture of these covering parts and their fastening to the protective cover.

Other features which are considered as characteristic for the invention are set forth in the appended claims.

Although the invention is illustrated and described herein as embodied in an umbrella-type clothes drier comprising a protective cover, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
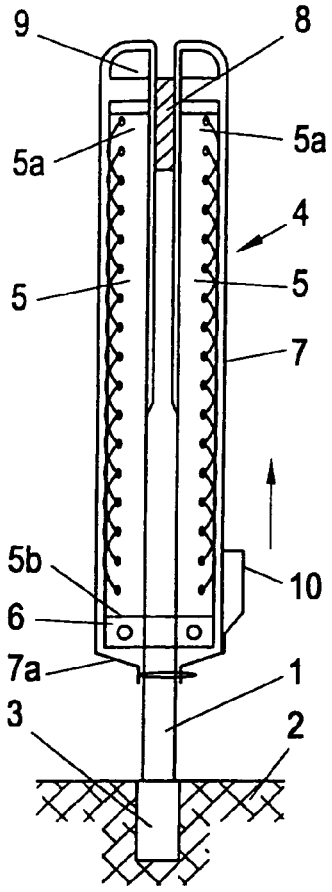
FIG. 1 is a side elevation showing an umbrella-type laundry drying apparatus (i.e., clothes drier) according to the invention with folded-together spreading frame, protective cover pulled over, and one-part covering flap.

Referring now to the figures of the drawing in detail and first, particularly, to FIG. 1 thereof, there is shown an umbrella-type laundry drying apparatus, also referred to as a clothes drier, with a vertically arranged, central upright tube 1 or pipe, which is anchored at its lower end in a ground sleeve 3 let into the ground 2 and on which a spreading frame 4, which can be spread apart into a spread position and folded back in a folded position and carries the clothes line, is arranged height-adjustably. The spreading frame 4 is folded together and its support arms 5 bearing the clothes line are folded with their free upper ends 5*a* toward the upper end of the upright tube 1, while their lower ends 5*b* are articulated on the lower sleeve 6, which surrounds the upright tube 1, of the spreading frame 4 and are together with this sleeve displaced into their lower end positions for folding the spreading frame 4 together.

Figure 4:
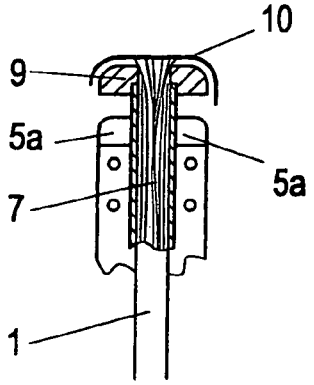
FIG. 4 is a partial side view of an upper end portion of an umbrella-type laundry drying apparatus with folded-together spreading frame, protective cover pulled back into the upright tube and a one-part covering flap covering the upper side of the upright tube.

Accommodated in the upright tube 1 is a tubular protective cover 7 which extends upward in the upright tube 1 from a weight 8 to the upper end of the upright tube 1, where it passes a trumpet-shaped deflection sleeve 9, which projects outward over the folded-together spreading frame 4 and turns the protective cover 7 with its inner side out, while it is pulled downward on the outside of the folded-together spreading frame 4 over the clothes line hanging down in short loops from the support arms 5 and is finally fastened to the upright tube 1 below the lower sleeve 6 of the spreading frame 4. The protective cover 7 bears on its outer end portion 7*a*, which overlaps the lower sleeve 6 of the spreading frame 4 downwardly from above, a lateral covering flap 10, which projects upwardly from the end portion and overlaps the upper side of the upright tube 1 (FIG. 4) when the protective cover 7 has been pulled back into the upright tube 1.

If the protective cover 7 pulled over the folded-together spreading frame 4 is unfastened from the upright tube 1 below the spreading frame 4 and thus freed, the weight 8 falling downward in the upright tube 1 pulls the protective cover 7 upwardly off the folded-together spreading frame 4, and the protective cover 7 is at the upper end of the upright tube 1 deflected by 180° into the interior of the upright tube 1 by the trumpet-shaped deflection sleeve 9. The covering flap 10 attached to the outer end portion 7*a* of the protective cover 7 is pushed over the upper end of the upright tube 1 above the trumpet-shaped deflection sleeve 9 by the protective cover 7 which has been pulled into the upright tube 1 below it and covers the trumpet-shaped deflection sleeve 9 and the upright tube 1 upwardly when the protective cover 7 has been pulled back into the upright tube 1 completely.

Figure 2:
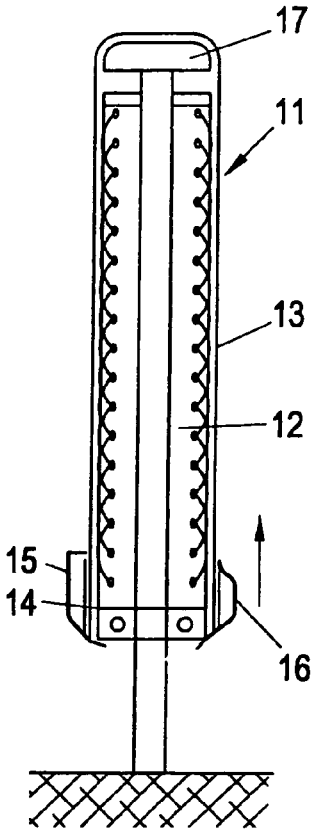
FIG. 2 is a similar view of the apparatus with folded-together spreading frame, protective cover pulled over, and two-part covering flap.
Figure 5:
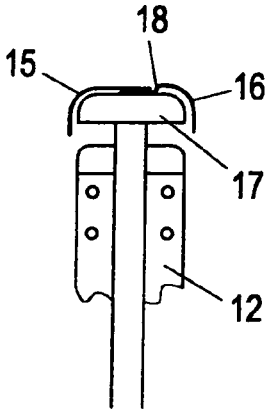
FIG. 5 is a partial side view of an upper end portion of an umbrella-type clothes drier with folded-together spreading frame, protective cover pulled back into the upright tube, and a two-part covering flap covering the upper side of the upright tube.

FIGS. 2 and 5 show an umbrella-type clothes drier 11 with a folded-together spreading frame 12 and a protective cover 13 pulled over which bears on its outer end portion 14 fastened to the lower sleeve of the spreading frame 12 two mutually opposite flaps 15, 16 which at the upper end of the upright tube are pushed over the upper end of the trumpet-shaped deflection sleeve 17 from opposite sides by the protective cover 13 which has been pulled into the upright tube below them and together cover the sleeve upwardly. In this connection, the left flap 15, in FIGS. 2 and 5, is pushed with its front end over the front end of the right flap 16 until it comes up against the step 18 of the right flap 16 and in this way terminates the pulling of the protective cover 13 into the upright tube.

Figure 3:
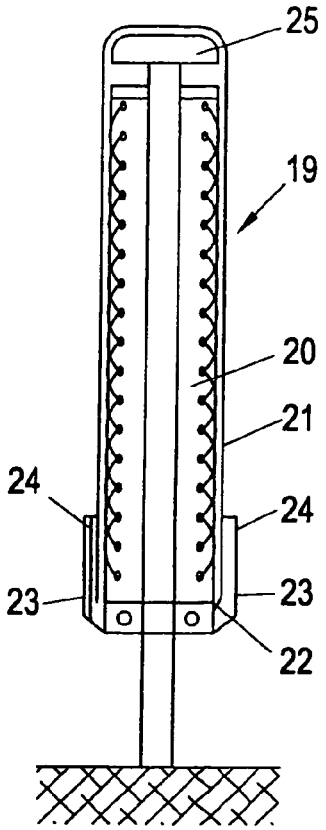
FIG. 3 is a similar view of the apparatus with folded-together spreading frame, protective cover pulled over, and covering parts protruding from material pockets.
Figure 6:
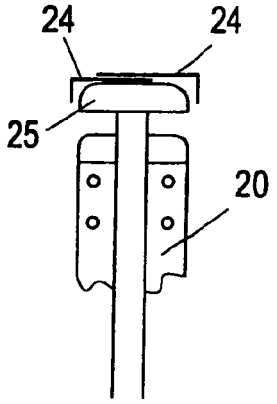
FIG. 6 is a similar partial side view with folded-together spreading frame, protective cover pulled back into the upright tube, and covering parts protruding from material pockets and covering the upper side of the upright tube.

FIGS. 3 and 6 show a further umbrella-type clothes drier 19 with a folded-together spreading frame 20 and a protective cover 21 pulled over which bears on its outer end portion 22 fastened to the lower sleeve of the spreading frame 20 two or more material pockets 23 which are arranged distributed around the upright tube 1 and from which rigid, leaf-shaped covering parts 24 project which are pushed over the upper end of the trumpet-shaped deflection sleeve 25 by the protective cover 21 which has been pulled back into the upright tube and together cover the sleeve completely upwardly when the protective cover 21 has been pulled back into the upright tube completely.

Additional information concerning the background and concepts of the umbrella-type clothes dryer are found in my copending application Ser. No. 10/920,888 filed Aug. 18, 2004, which is herewith incorporated in its entirety.

I claim:

1. An umbrella-type laundry-drying apparatus, comprising:

a central upright tube formed with an inner space and an upper end;

a spreading frame movably mounted on said upright tube for spreading outwardly from said upright tube into a spread-out position and folding back toward said upright tube into a folded position;

a protective cover disposed to be pulled out of said inner space in said upright tube and over said spreading frame in said folded position and to be pulled back into said inner space of said upright tube; and a covering mounted to said protective cover on an outer end portion thereof, said covering overlapping said upper end of said upright tube when said protective cover has been pulled back into said inner space of said upright tube.

2. The apparatus according to claim 1, wherein said covering is at least one covering flap connected to the outer end portion of said protective cover.

3. The apparatus according to claim 1, wherein said covering is a multi-part covering connected to the outer end portion of said protective cover, said covering having covering parts distributed about the outer end portion of said protective cover and, when said protective cover has been pulled back into said upright tube, together covering an upper opening of said upright tube.

4. The apparatus according to claim 3, wherein said covering parts that together cover said upper end of said upright tube overlap one another at least partly.

5. The apparatus according to claim 1, wherein said spreading frame is height-adjustably mounted to said upright tube.

6. An umbrella-type laundry-drying apparatus, comprising:

a central upright tube formed with an inner space and an upper end;

a spreading frame carrying clothes line, said spreading frame being movably mounted on said upright tube for spreading outwardly from said upright tube into a spread-out position and folding back toward said upright tube into a folded position;

a protective cover disposed to be pulled out of said inner space in said upright tube and over said spreading frame and said clothes line in said folded position and to be pulled back into said inner space of said upright tube at an inner end portion, which remains in the upright tube; and a covering mounted to said protective cover on an outer end portion thereof, said covering overlapping said upper end of said upright tube when said protective cover has been pulled back into said inner space of said upright tube.

7. The apparatus according to claim 6, wherein said spreading frame is height-adjustably mounted to said upright tube.

* * * * *